United States Patent [19]

Post et al.

[11] Patent Number: 4,997,025

[45] Date of Patent: Mar. 5, 1991

[54] LINING PLATE FOR THE MOLDING SPACE OF FLASK-LESS MOLDING MACHINES

[76] Inventors: Harry Post, Tuchstr. 38, D-5608 Radevormwald; Karin Schuch, Echoer Str. 20, D-5600 Wuppertal 21, both of Fed. Rep. of Germany

[21] Appl. No.: 565,219

[22] Filed: Aug. 7, 1990

Related U.S. Application Data

[63] Continuation of Ser. No. 378,527, filed as PCT DE88/00670 on Oct. 29, 1988, published as WO89/03737 on May 5, 1989, abandoned.

[30] Foreign Application Priority Data

Oct. 31, 1987 [DE] Fed. Rep. of Germany ..... 3736967
Oct. 27, 1988 [DE] Fed. Rep. of Germany ..... 3836622

[51] Int. Cl.[5] ..... B22C 19/00
[52] U.S. Cl. ..... 164/187; 164/40
[58] Field of Search ..... 164/187, 188, 40

[56] References Cited

U.S. PATENT DOCUMENTS

| | | | |
|---|---|---|---|
| 3,734,163 | 5/1973 | Larkin | 164/187 |
| 3,749,151 | 7/1973 | George et al. | 164/187 X |
| 3,817,314 | 6/1974 | Deve | 164/187 X |
| 3,830,283 | 8/1974 | Gunnergaard | 164/40 X |
| 3,999,594 | 12/1976 | Gunnergaard | 164/187 |
| 4,437,507 | 3/1984 | Seeley | 164/187 X |

FOREIGN PATENT DOCUMENTS

| | | |
|---|---|---|
| 3319463 | 11/1984 | Fed. Rep. of Germany . |
| 3626994 | 12/1987 | Fed. Rep. of Germany . |

OTHER PUBLICATIONS

Disamatic 2013/2023, Firma Dansk Industri Syndikat A/S.

Disamatic 2070, Firma Dansk Industri Syndikat A/S.

Verwendung von Magnetplatten zur Herstellung von Kleinserien auf Formmaschinen, Giessereitechnik 8 Jahrgang, 1962, pp. 16, 17.

*Primary Examiner*—Richard K. Seidel
*Assistant Examiner*—J. Reed Batten, Jr.
*Attorney, Agent, or Firm*—Herbert Dubno

[57] ABSTRACT

A lining plate for the molding space of a molding machine is provided with functional openings such as sand supply openings and air-exhaust openings traversing the lining plate, the latter openings optionally provided with nozzle inserts. The lining plate is subdivided into two plate layers detachably fastened to each other, namely into a wear plate bordering the molding space and a carrier plate supporting the back of the wear plate. The mutually facing larger surface areas of the wear—and carrier plate are kept fully adherent to each other by magnet clamps and are additionally insured, in a detachably form-locking manner, against relative displacement with respect to each other. The lining plate allows a problem-free and comparatively cost-efficient restoration afer wear.

14 Claims, 7 Drawing Sheets

LINING PLATE FOR THE MOLDING SPACE OF FLASK-LESS MOLDING MACHINES

This is a continuation of a co-pending application Ser. No. 07/378,527 filed on July 14, 1989 and now abandoned.

FIELD OF THE INVENTION

The invention relates to a lining plate for the molding space of flask-less molding machines.

THE RELATED ART

Flask-less molding machines have a molding space wherein the circumferential boundaries of the inner shell are provided with lining plates at least at the top and on the sides. In such a molding space known also as a press compartment, a succession of mold blocks made of molding sand is pressed in an intermittent operation between two plates frontally limiting the mold space. The molding space is defined by an upswingable inner pattern plate on the one side and a translatorily slidable outer pattern plate on the other side. After the inner pattern plate has swung upwardly, the outer pattern plate driven by a hydraulic piston pushes the mold block outwardly, against a respective, already existent mold block, so that a line consisting of numerous mold blocks results. In this mold-block line, the respective mold cavities of two frontally adjacent mold blocks complement each other, forming an integral mold cavity.

Introduction of the molding sand in the molding space or press compartment is done through blasting with an excess of air. This air has to be removed in order to avoid the formation of hollows within the mold blocks, and this is done via nozzle-like outlet openings which traverse the lining plate walls.

The lining plates are subject to considerable abrasive wear, resulting on the one hand from the blasting with molding sand into the mold space, and on the other hand from the relative motion between the lining plates and the mold block to be expelled. As soon as the wear at lining plates surpasses a preselected tolerance, the lining plates must either be entirely or partially replaced. Up to now, the lining plates subjected to the heaviest wear, namely the two lateral lining plates and the top lining plate containing the slot-shaped inlet opening for molding sand were replaced altogether.

The lining plates of the known kind require first a considerable machining effort, namely drilling in order to make the nozzle openings and grinding. Finally these known lining plates are subjected to case hardening, which is quite expensive due to the considerable thickness of the plate. Even then, the handling of the known, for instance 3 cm thick plates, is problematic due to its weight. Most importantly, these heavy weight plates when dropped may lead to serious accidents.

Departing from the known lining plate, as for instance described in DE-OS 33 19 463, it is the object of the invention to create a lining plate easily restorable after wear and generally a lining plate which can be produced at lower cost.

SUMMARY OF THE INVENTION

According to the invention there is provided a new lining plate comprising a set of two plates, detachably fastened and fully adherent to each other, namely of a wear plate limiting the molding space and a carrier plate positioned behind the wear plate. By means of magnetic clamps, both plates are kept adherently and form-locked in a normal direction, so that they fully adhere to each other. In order to generally avoid a relative displacement of the wear—and carrier plates, particularly during expulsion of the mold block, both plates are detachably form-lockingly connected to each other, namely in the most simple manner, such as by screw elements traversing the plates, in transversal direction with respect to the extent of the plates.

Among the advantages of the lining plate of the invention is that the carrier plate can always remain mounted on the machine side. Secondly, the carrier plate can be made of a cheaper material, such as structural steel of the St 37 quality, while only the wear plate need be formed from hardened tool steel with a hardness of for instance 74 $HR_C$.

Now, when the wear plate of a lining plate according to the invention is worn out beyond the acceptable tolerance, only form-locking means (e.g. the mentioned screws) must be removed. Thereafter the wear plate can be detached from the carrier plate by overcoming the magnetic adhesion force. With the aforedescribed arrangement it is easily understandable that refitting of the worn-out surfaces limiting the molding space becomes much simpler. Moreover, due to the considerably lower weight of the respective element to be replaced (wear plate), less power is necessary to accomplish the task.

The lining plate according to the invention can be produced, at least time-wise, with less effort. At a general thickness of the lining plate of 3 cm, the thickness of the wear plate is of only 1 cm, while the thickness of the carrier plate is of 2 cm. Therefore, the wear plate of the invention requires a much smaller hardening effort, due to its reduced thickness and a reduced volume of material to be hardened. In other words since the wear plate of the invention has only a reduced volume of hardened material due to its reduced thickness, in comparison to the thrice thicker known wear plate, in the case of the wear plate according to the invention it is possible to achieve a higher degree of hardness, and thereby a longer service life, with comparativley lower costs. Reduction in thickness of the wear plate concomitantly considerably reduces the requirement for machining operations, e.g. drilling for the production of the nozzle openings.

BRIEF DESCRIPTION OF THE DRAWINGS

In the drawing, the invention is more precisely illustrated with the aid of preferred embodiments, which show:

as shown in FIG. 1, FIG. 3 a partially broken off longitudinal section along the line III—III in FIG. 2;

DETAILED DESCRIPTION

Figure 1:
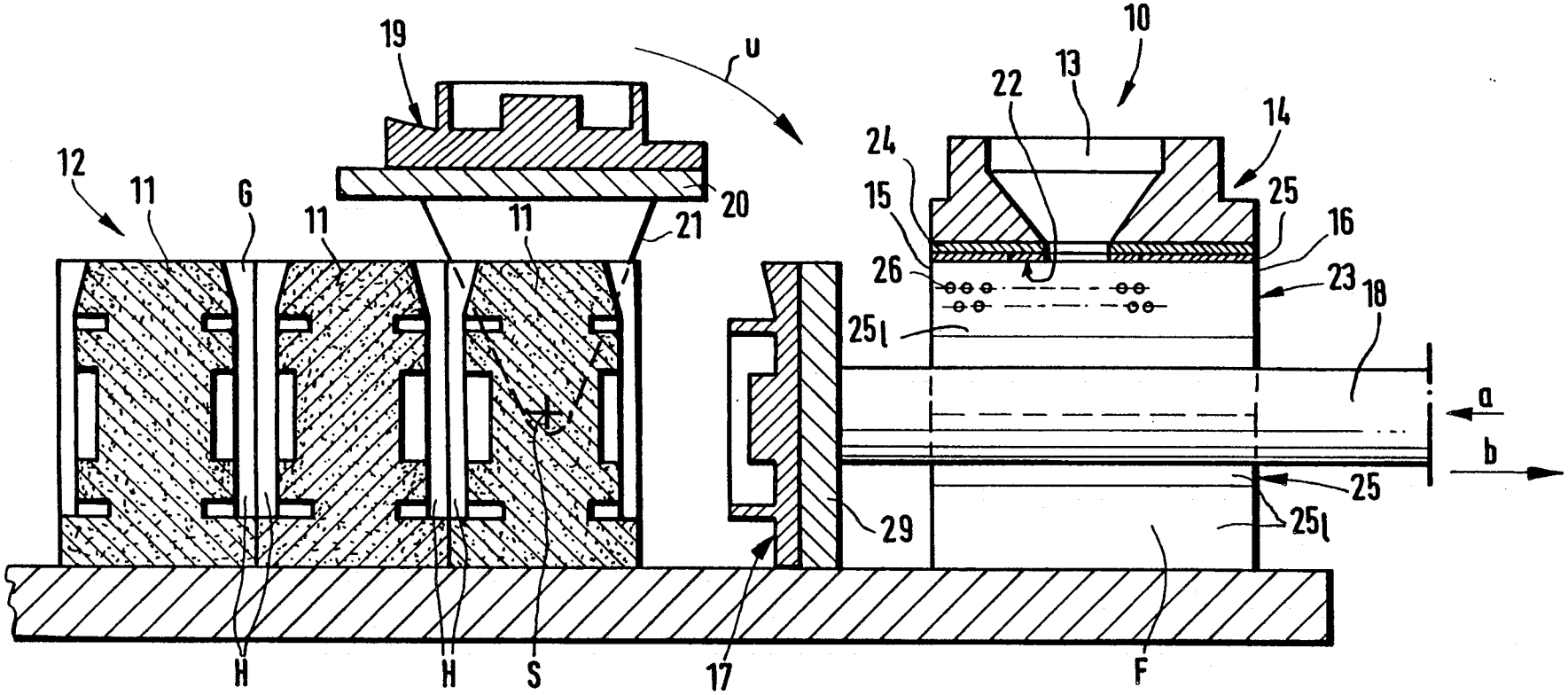
FIG. 1 a schematic sectional view of a flask-less molding machine.

In FIG. 1 is illustrated a flask-less molding machine 10 for the production of individual mold blocks 11 of a mold-block line 12.

Each of the two adjacently positioned frontal sides of the mold blocks 11 form in axial direction successive integral mold cavities H, each of them being supplied through a schematically indicated casting down-gate G with molten metal. In the present case, the mold cavity defines approximately an axially symmetrical configuration, similar to a flywheel, with a hub.

The production of an individual mold block 11 takes place as follows:

Through a feeding funnel 13 on the machine side of a box-like machine frame 14, molding sand is blown with high input velocity into the otherwise completely closed molding space or press chamber F. In FIG. 1, the molding space F is shown with an outer frontal opening 16 and with an inner frontal opening 15. In order to close the hollow space, the outer pattern plate 17, representing the one press plate, is retracted by means of a hydraulically actuated piston rod 18 to the right in the direction of the arrow b through the hollow space F so far, until the pattern plate 17 closes the outer frontal opening 16.

In the closed position of the hollow molding space F an inner pattern plate 19, pivotable around a swivel axis S in the direction of the arrow u, closes the other, i.e. inner frontal opening 15 of the molding space F. For this purpose, the inner pattern plate 19 is fastened to a fixing plate 20 equipped with a swinging bracket 21.

The fixing plate holding the outer pattern plate 17, provided at one end with the piston rod 18, is marked with 29.

As soon as the molding space F, closed in the above-described manner, is filled with molding sand, the outer pattern plate 17 is pushed in the direction of the arrow a by approximately 10–15 mm, so that a compacted sand mold-block 11 results. After the inner pattern plate 19 is swung upwardly in the position shown in FIG. 1, so that it does not hinder the travel of the form block 11, the outer pattern plate 17 is pushed by the actuated piston rod 18 and moves the mold block 11 in the direction of the arrow a, up to the rear frontal end of the already existing mold block 11, on the side of the mold-block line.

It is conceivable that the surfaces internally defining the molding space F, at least the interior surface towards the roof and the two lateral interior surfaces, which together form a downwardly opening U, are subjected to a considerable abrasive wear, during the introduction of the respective molding sand, but especially during the expulsion of the mold block blank.

This abrasive wear has been taken into consideration, by providing the inner roof surface of the molding space F with a roof-lining plate 22, and each of the two lateral surfaces of the inner shell defining the molding space F with a lateral lining plate 23. Basically, both lining plates 22, 23, are essentially of identical construction.

As can be seen already from FIG. 1, the roof-lining plate 22 (and also each lateral lining plate 23) consists of a set of two plates, i.e. of one wear plate 25 directly facing the molding space F and of a carrier plate 24, fully adhering to the back of the wear plate 25. It can also be seen from FIG. 1 that the wear plate 25 of the lateral lining plate 23 consists of four approximately horizontally extending strip-like longitudinal plate elements $25_l$. Besides, in FIG. 1, the nozzle openings 26 are already schematically indicated, these nozzles serving for the evacuation of excess air which could cause hollow spaces in the mold blocks 11.

Figure 2:
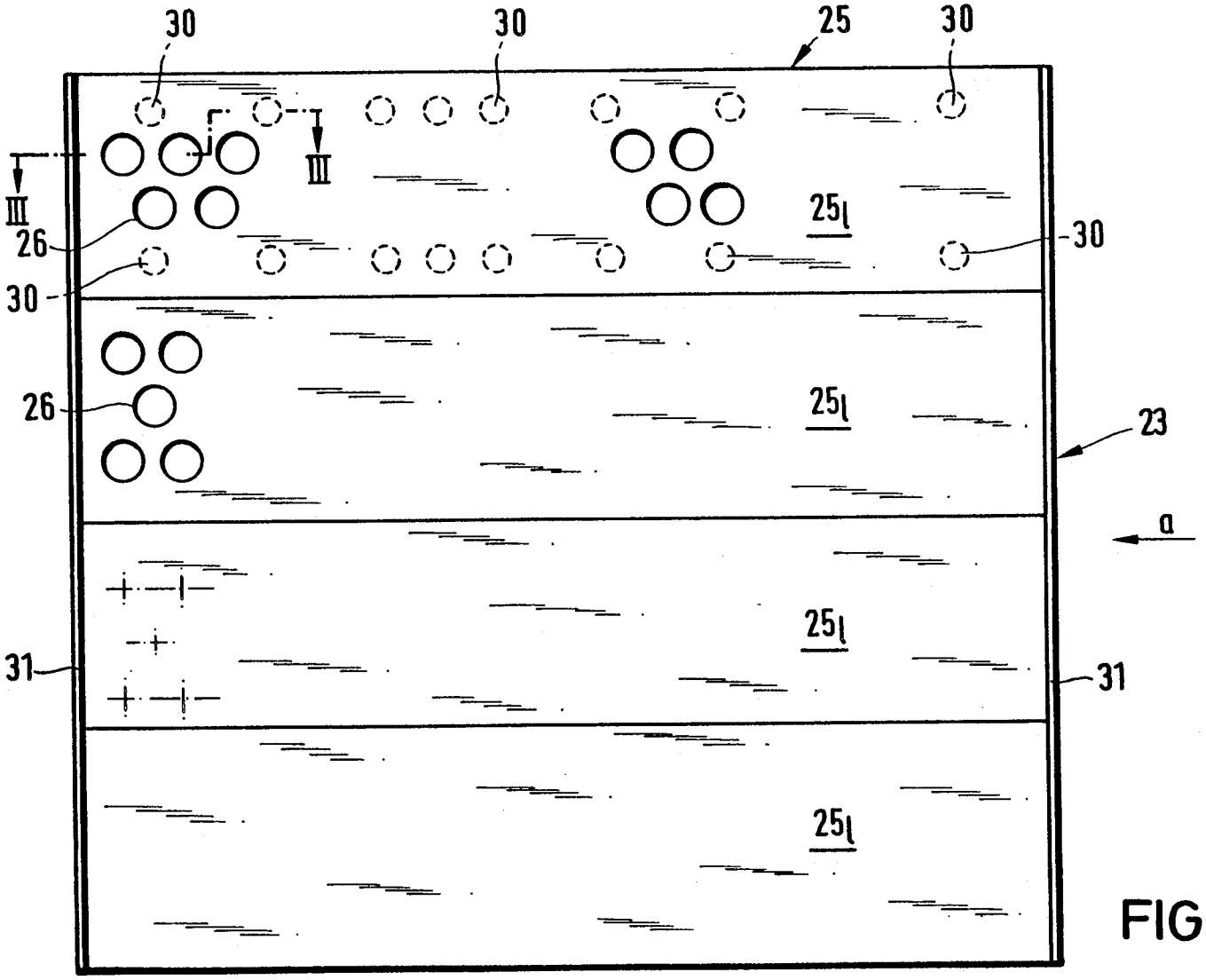
FIG. 2 an enlarged representation of the lining plates laterally limiting the molding-or press space.
Figure 4:
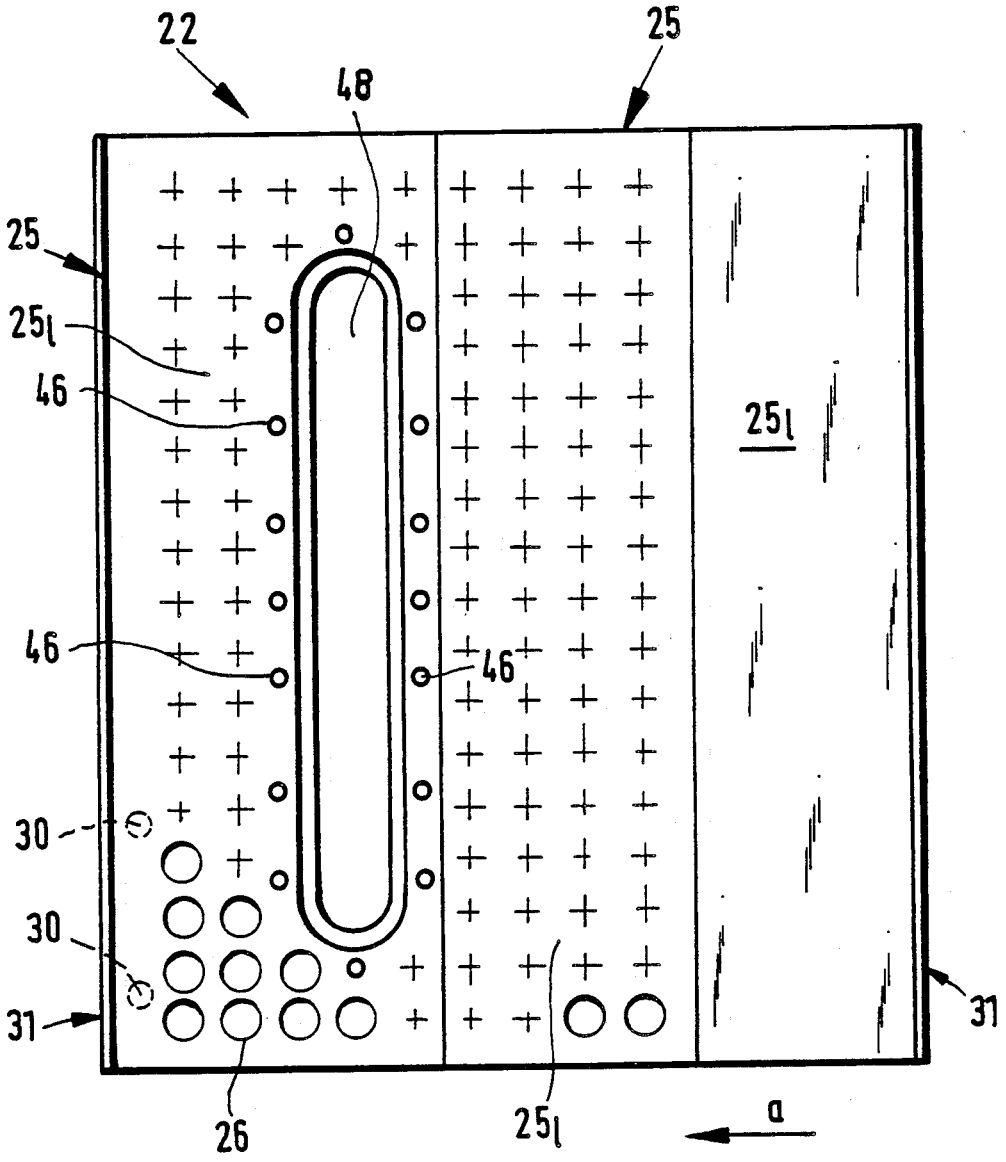
FIG. 4 a bottom view of the lining plate located at the top of the molding-or press space.

FIG. 2 represents one of the two lateral lining plates 23, while FIG. 4 shows the roof-lining plate 22. As much as possible, with reference to the two lining plates 22, 23, the same reference numerals are used in connection with the same functional parts.

Figure 3:
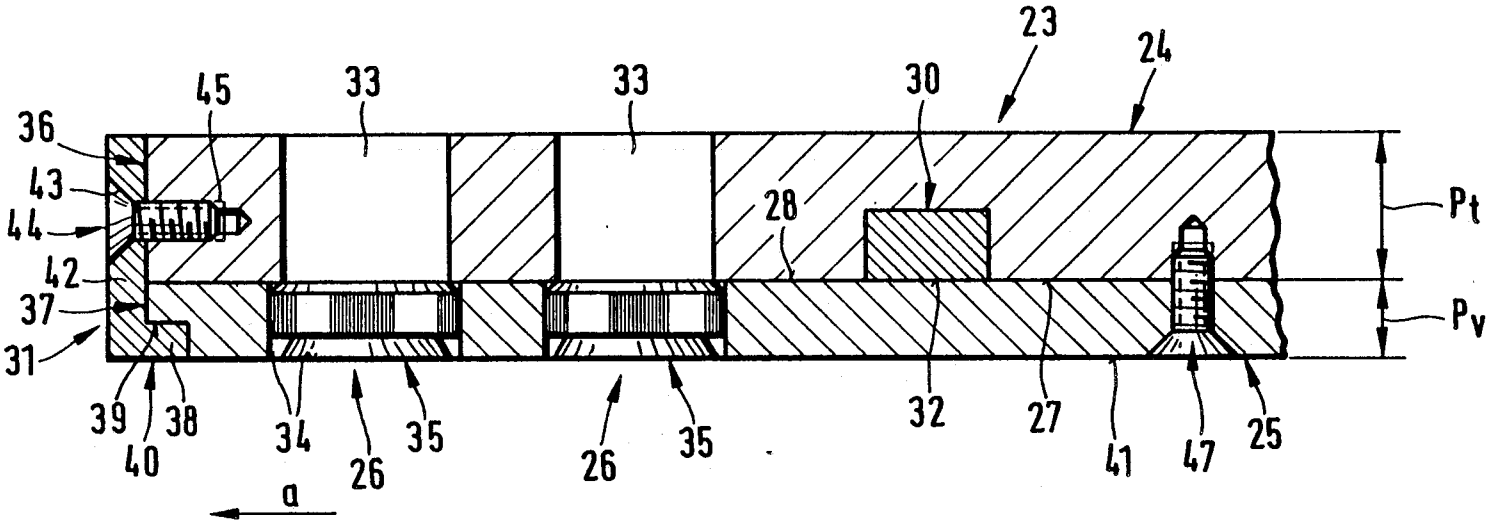

From FIG. 3, the two-layer construction of a lateral lining plate 23 can be seen, which is also representative of the roof-lining plate 22.

The lining plate 23 is subdivided in two detachably connected plate layers, namely the wear plate 25 directly lining the molding space F and the carrier plate 24, supporting the back of the wear plate. The large mutually facing surface areas 28 and 27 of the wear plate 25 and the carrier plate 24 are kept fully adherent to each other by a permanent magnet clamp 30, and are insured against any relative displacement, e.g. in the axial direction particularly in direction a, by cleats 31 provided at both ends.

The magnet clamps 30 with their plane adhesion surface 32 are flush with the surrounding large surface area 27 of the carrier plate 24 and imbedded in the latter.

From FIG. 3 (represented on the approximate scale 1:1) it can be seen that the wear plate 25 has a considerably smaller plate thickness $P_v$ than the carrier plate 24. In the present case, the thickness $P_t$ of the carrier plate 24 is of 2 cm, while the thickness $P_v$ of the wear plate amounts to only 1 cm.

The wear plate 25 is made of magnetic tool steel, is specially hardened and coated and has, for instance, a hardness of 74 HR. By contrast, the carrier plate 24 is made only of regular, untreated structural steel such as quality St 37 or other even non-metallic materials.

Carrier plate 24 and wear plate 25 have mutually aligned passage openings 33, 34. The passage openings 34 on the side of the wear plate are provided with nozzle inserts 35.

The mutual form-locking against a relative displacement of the wear plate 25 and the carrier plate 24 is insured by two cleats 31, provided at both ends of each of the lateral lining plates 23 (the same applies to the roof-lining plate 22) which extend vertically with respect to the direction of the main displacement strain. Each cleat 31 flushly overlaps two neighboring narrow sides 36, 37 of the carrier plate 24 and the wear plate 25 over the entire thickness ($P_t$ plus $P_v$) of the respective lining plate 22, 23. The cleats 31 have the same material characteristics and the same hardness as the wear plate 25.

Each cleat 31 consists of an angled steel-profile segment, which engages with an overlapping shoulder 38 into a recess 39 on the wear-plate side opening towards the molding space F. Thereby, the outer surface 40 of the overlapping shoulder 38 facing the molding space F is flush with the adjacent large surface area 41 (which directly lines the molding space F) of the wear plate 25.

The fastening flank 42 of the cleat 31 pressing against the narrow side of the carrier plate 24 has fastening holes 43 for the passage of fastening screws 44, which engage in the threaded blind holes 45, which are provided in the respective narrow side of the carrier plate 24.

Figure 5:
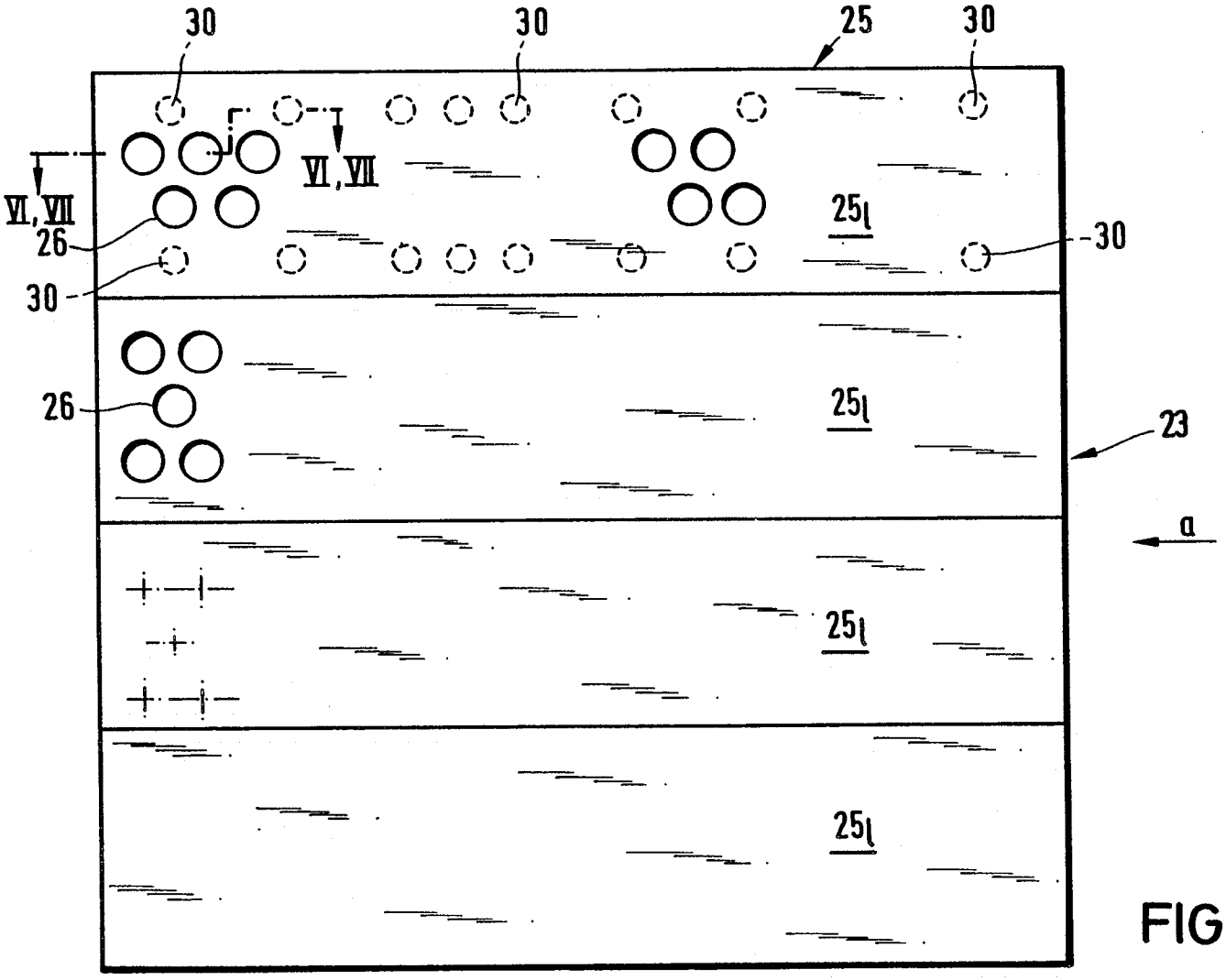
FIG. 5 a representation according to FIG. 2 of another embodiment.

In addition, from FIGS. 2, 4 and 5 it can be seen that each wear plate 25 is subdivided into strips and consists of individual longitudinal plate elements $25_l$. The strip-like subdivision of each wear plate 25 into individual longitudinal plate elements $25_l$ facilitates the general as well as the partial replacement of worn-out longitudinal plate elements $25_l$ with new ones.

It also has to be said with reference to the illustrations of FIG. 2, 4 and 5, that nozzle openings 34 and sintered-metal magnet clamps 30 are only shown in a few spots, for the sake of simplicity.

It also has to be mentioned with regard to FIG. 4 that the therein shown slotted molding-sand supply opening 48 is surrounded by individual screw elements 46, which engage in threaded blind holes (not shown in the drawing) of the carrier plate 24, in order to increase the safe adhesion of the individual wear-plate elements $25_l$ to the carrier plate 24, in the area of the feeding opening 48.

From the preceding illustrations it becomes clear that the wear plate 25 can be quickly and simply replaced when needed, while the respective carrier plate 24 can remain connected to the boxlike stand 14 on the machine side.

Considering the interconnection between particularly FIGS. 2, 4 and 5, it becomes clear that the longitudinal axes of the plate elements $25_l$ extend in parallel to the direction of the main displacement strain according to FIGS. 2 and 5, and transversally thereto, according to FIG. 4.

Alternately or additionally, screws 47 can be provided to insure the form-locking against any relative displacement between the plates 24, 25. See FIG. 2.

Figure 6:
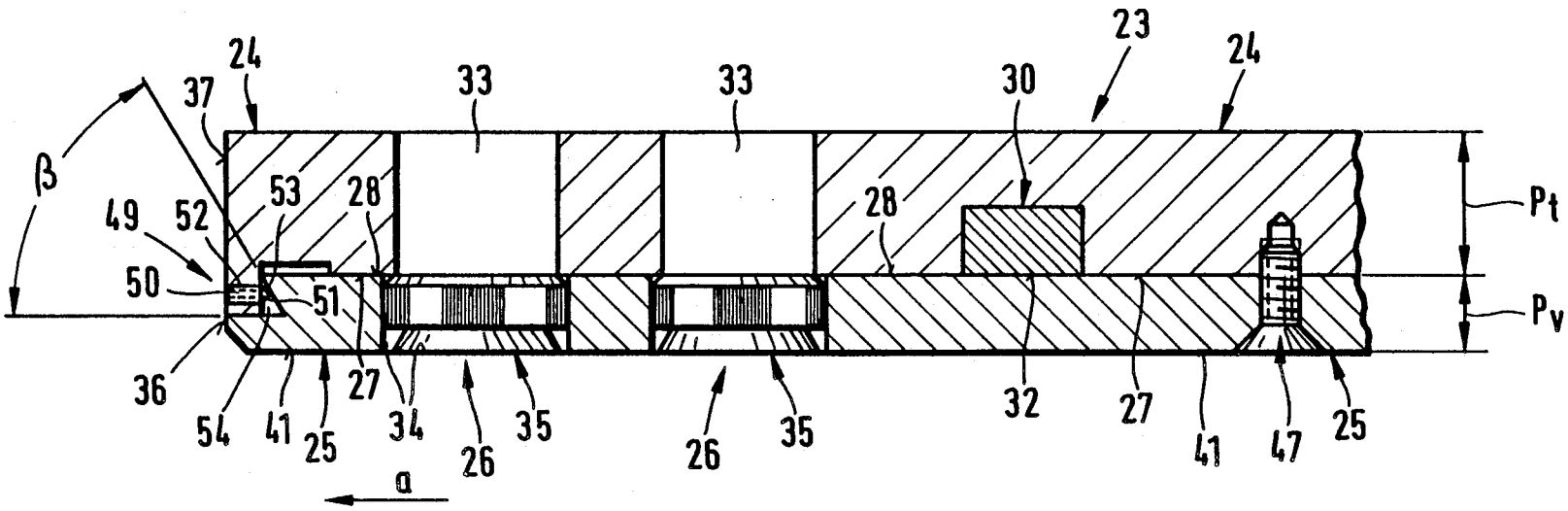
FIG. 6 a partially broken off longitudinal section along the line VI—VI in FIG. 5.
Figure 7:
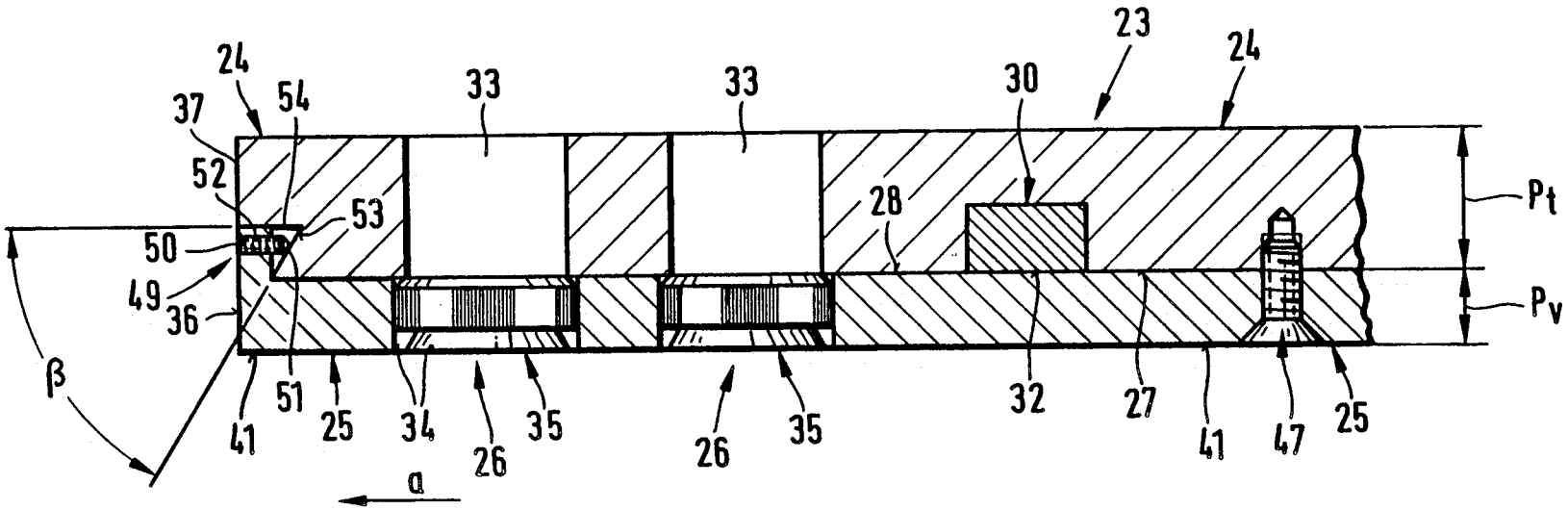
FIG. 7 a partially broken off longitudinal section along the line VII—VII in FIG. 5 in a modified embodiment.

In order to insure the form-locking against a relative displacement of the wear plate 25 and the carrier plate 24 with respect to each other, in FIGS. 6 and 7 two embodiments are alternately provided.

According to FIG. 6, the wear plate 25 has a continuous, undercut flute 54, extending transversally with respect to the main direction a of the displacement strain. The flute 54 is limited towards the middle of the wear plate 25 by an undercut surface 53, which defines an acute angle $\beta$ together with the mutually adhering large surface areas 27, 28 on the plate side. Both narrow sides 36, 37 of wear plate 25 and carrier plate 24 are flush.

In accordance with FIG. 6 on the narrow side 27 of the carrier plate 24, approximately at the level of the flute 54, a corresponding shoulder 49 is provided, which has several spaced-apart threaded holes 52 for receiving the set screws 50. The conical point 51 of the set screw 50 cooperates with the plane undercut surface 53 as if it were an inclined plane. This works in such a way that when the set screw 50 is fully threaded in, its cone 51 acts upon the undercut surface 53 in the sense of pulling together the large surface areas 27, 28.

The large surface area of the wear plate 25 facing the molding space is marked with 41.

The embodiment according to FIG. 6 is a particularly preferred embodiment example.

The embodiment example according to FIG. 7, in comparison to the one in FIG. 6, represents basically a geometrical inversion, consisting in the fact that the flute 54 is part of the carrier plate 24, while the shoulder 49 is part of the wear plate 25.

We claim:

1. A lining plate for a molding space of a flask-less molding machine comprising:

a wear plate bordering said molding space, said wear plate having a front and a back surface turned away from one another;

a carrier plate having a surface in contact with said back surface of said wear plate and supporting said wear plate, said carrier plate being formed with a passage for communicating with said space, said wear plate having a hole registering with said passage;

at least one magnetic clamp, said clamp being interposed between and functioning to join together said wear and carrier plates; and means for detachably form-locking said wear and carrier plates to additionally secure against mutual relative displacement of said plates.

2. A lining plate according to claim 1, wherein said magnetic clamp has a surface which is flush with said surface of said carrier plate and embedded therein.

3. A lining plate according to claim 1, wherein said magnetic clamp is a permanent magnet having basically a shape selected from the group consisting of circular, cylindrical and rectangular shapes.

4. A lining plate according to claim 3 wherein said magnetic clamp is made of sintered material.

5. A lining plate according to claim 1, wherein said wear plate has a considerably smaller thickness than that of said carrier plate.

6. A lining plate according to claim 1, wherein said wear plate has a considerably higher degree of hardness than that of said carrier plate.

7. A lining plate according to claim 1, wherein one of said wear and carrier plates further comprises as a safeguard against relative displacement a projecting shoulder engaging a recess of said plates, said shoulder being directed transverse to said back surface of said wear plate, said shoulder including a threaded hole running transverse to a narrow face of said plates, a screw passing through said hole and having a free end resting against an undercut surface of said recess, said undercut surface forming an acute angle with an adjacent surface parallel to said back surface.

8. A lining plate according to claim 7, wherein said projecting shoulder of one plate only partially enters said recess of said other plate and wherein said recess is in flute form having a unilaterally dove-tailed undercut surface.

9. A lining plate according to claim 8, wherein said shoulder of the carrier plate and said flute of said wear plate are associated.

10. A lining plate for a molding space of a flask-less molding machine comprising:

a wear plate bordering said molding space, said wear plate having a front and a back surface turned away from one another;

a carrier plate having a surface in contact with said back surface of said wear plate and supporting said wear plate;

at least one magnetic clamp, said clamp being interposed between and functioning to join together said wear and carrier plates; and means for detachably form-locking said wear and carrier plates to additionally secure against mutual relative displacement of said plates said means for detachably form-locking said plates comprising at least one cleat extending transversely to a direction along which sandblocks formed by said machine are transported, said cleats flushly overlapping two neighboring sides of said wear and carrier plates over a total thickness of said lining plate, said cleats having a hardness identical to that of said wear plate.

11. A lining plate according to claim 10, wherein said wear plate comprises a flute formed along an outer perimeter of said plate adjacent said front surface and opening toward said molding space, and said cleat further comprising a fastening flank and a shoulder at right angles thereto, said shoulder projecting within said flute, said shoulder having a surface facing said molding face and being flush with said front surface of said wear plate.

12. A lining plate according to claim 11, wherein said fastening flank of said cleat presses against a narrow side of said carrier plate, said flank having at least one fastening hole, said carrier plate having a threaded bore in said narrow side corresponding to said hole, said hole and bore receiving a fastening screw therebetween.

13. A lining plate for a molding space of a flask-less molding machine comprising:

a wear plate bordering said molding space, said wear plate having a front and a back surface turned away from one another;

a carrier plate having a surface in contact with said back surface of said wear plate and supporting said wear plate;

at least one magnetic clamp, said clamp being interposed between and functioning to join together said wear and carrier plates; and means for detachably form-locking said wear and carrier plates to additionally secure against mutual relative displacement of said plates said wear plate being subdivided into strip-like segments consisting of individual longitudinal plate elements.

14. A lining plate according to claim 13, wherein said longitudinal plate elements are positioned parallel to a direction along which sandblocks formed by said machine are transported.

* * * * *